US009889550B1

(12) United States Patent
McNeny et al.

(10) Patent No.: US 9,889,550 B1
(45) Date of Patent: Feb. 13, 2018

(54) STEP DOWN HANDLE FOR A HAND TOOL

(71) Applicants: Simon McNeny, Garland, TX (US); Larry McNeny, Garland, TX (US)

(72) Inventors: Simon McNeny, Garland, TX (US); Larry McNeny, Garland, TX (US)

( * ) Notice: Subject to any disclaimer, the term of this patent is extended or adjusted under 35 U.S.C. 154(b) by 693 days.

(21) Appl. No.: 13/791,198

(22) Filed: Mar. 8, 2013

Related U.S. Application Data

(60) Provisional application No. 61/619,505, filed on Apr. 3, 2012.

(51) Int. Cl.

| | |
|---|---|
| ***B25G 1/10*** | (2006.01) |
| ***E04D 15/00*** | (2006.01) |
| *E04D 15/02* | (2006.01) |
| *B25G 1/00* | (2006.01) |

(52) U.S. Cl.
CPC ..... *B25G 1/10* (2013.01); *E04D 15/003* (2013.01); *B25G 1/00* (2013.01); *E04D 15/02* (2013.01)

(58) Field of Classification Search
CPC ..... E04D 15/003; E04D 15/02; E04G 23/006; B25G 1/105; B25G 1/00
USPC ..... 81/45, 46, 489
See application file for complete search history.

(56) References Cited

U.S. PATENT DOCUMENTS

| | | | | |
|---|---|---|---|---|
| 2,818,291 | A * | 12/1957 | Corns | B25G 1/04 15/144.1 |
| 3,374,986 | A * | 3/1968 | McElroy et al. | 256/59 |
| 4,704,758 | A * | 11/1987 | Hoffman | 15/144.4 |
| 4,793,646 | A * | 12/1988 | Michaud, Jr. | 294/210 |
| 5,603,584 | A * | 2/1997 | Schuele | 403/371 |
| 5,771,535 | A * | 6/1998 | Blessing | 16/430 |
| 6,023,924 | A * | 2/2000 | Babineau | 56/400.01 |
| 6,199,245 | B1 * | 3/2001 | Blessing | 16/430 |
| 6,704,968 | B2 * | 3/2004 | Lau | 16/426 |
| 6,709,529 | B1 * | 3/2004 | Mekwinski | 134/6 |
| 8,079,290 | B2 * | 12/2011 | Cox | 81/45 |
| 2010/0139047 | A1 * | 6/2010 | Eek | 16/430 |
| 2011/0219557 | A1 * | 9/2011 | Rosenzweig et al. | 15/144.1 |

* cited by examiner

*Primary Examiner* — Larry E Waggle, Jr.
*Assistant Examiner* — Danny Hong
(74) *Attorney, Agent, or Firm* — Michael Diaz

(57) ABSTRACT

A hand tool having a step down mechanism. The hand tool includes a step down mechanism having a plate with two opposing ends. The plate also has an upper surface and a lower surface. The step down mechanism has an upper tube located near the first end and projecting from the upper surface and a lower tube located near the second end and projecting from the lower surface. The hand tool also includes an upper shaft affixed to the upper tube and a lower shaft affixed to the lower tube. The lower shaft has a hand tool implement affixed to an end of the lower shaft. The upper tube is sized and shaped to receive and hold the upper shaft and the lower tube is sized and shaped to receive and hold the lower shaft. The step down mechanism may include a handle projecting upward from the upper tube.

16 Claims, 9 Drawing Sheets

STEP DOWN HANDLE FOR A HAND TOOL

RELATED APPLICATIONS

This utility application claims the benefit of U.S. Provisional Patent Application Ser. No. 61/619,505 filed Apr. 3, 2012 by Simon McNeny, which is hereby incorporated by reference.

BACKGROUND OF THE INVENTION

Field of the Invention

This invention relates to hand tools. Specifically, and not by way of limitation, the present invention relates to a handle attachment for a hand tool.

Description of the Related Art

The use of hand tools, such as shovels, rakes, and brooms are quite popular in and around the home and other living and work areas. In the example of a shovel, the shovel includes a blade end typically constructed of a heavy duty steel attached to an elongated wooden or plastic member. On the opposite side of the elongated member is a D-shaped handle. A user normally grasps the D-shaped handle with one hand and a portion of the elongated member with the other hand. However, the configuration of the handle and elongated member provides a very awkward and uncomfortable grip for the user. The user usually holds the elongated member with the user's wrist extended. This provides a very unnatural grip on the elongated member and can result in damage to the wrist and hand when using repetitively over a long period of time.

In addition to the uncomfortable grip necessary to hold and use the hand tool, a user must bend his back or stoop when positioning the hand tool end at a position below the user. With use of the hand tool for a period of time, it is quite common for a user's back to be strained or injured.

It would be advantageous to have a handle attachment for use on a hand tool to enable a comfortable grip by the user upon the handle while allowing less strain upon the back of the user. It is an object of the present invention to provide such an apparatus.

SUMMARY OF THE INVENTION

In one aspect, the present invention is a hand tool having a step down mechanism. The hand tool includes a step down mechanism having a plate with a first end and an opposite second end. The plate also has an upper surface and a lower surface. The step down mechanism has an upper tube located near the first end and projecting from the upper surface and a lower tube located near the second end and projecting from the lower surface. In addition, the hand tool also includes an upper shaft affixed to the upper tube and a lower shaft affixed to the lower tube. The lower shaft has a hand tool implement affixed to an end of the lower shaft. The upper tube is sized and shaped to receive and hold the upper shaft and the lower tube is sized and shaped to receive and hold the lower shaft. In one embodiment, the step down mechanism includes a handle projecting upward from the upper tube.

In another aspect, the present invention is directed to a step down mechanism for a hand tool. The step down mechanism includes a plate having a first end and an opposite second end. The plate also has an upper surface and a lower surface. Furthermore, the step down mechanism also includes an upper tube located near the first end and projecting from the upper surface and a lower tube located near the second end and projecting from the lower surface. The upper tube is sized and shaped to receive and hold an upper shaft of a hand tool and the lower tube is sized and shaped to receive and hold a lower shaft of a hand tool. The step down mechanism may also include a handle projecting upward from the upper tube.

In another aspect, the present invention is directed to a hand tool having a handle attachment. The hand tool includes a handle attachment having an elongated tube having two ends and a handle projecting upward from the elongated tube. The hand tool includes an upper shaft affixed to the first end of the elongated tube and a lower shaft affixed to the second end of the elongated tube. The lower shaft has a hand tool implement affixed to an end of the lower shaft. The first end of the elongated tube is sized and shaped to receive and hold the upper shaft and the second end of the elongated tube is sized and shaped to receive and hold the lower shaft.

DESCRIPTION OF THE INVENTION

Figure 1:
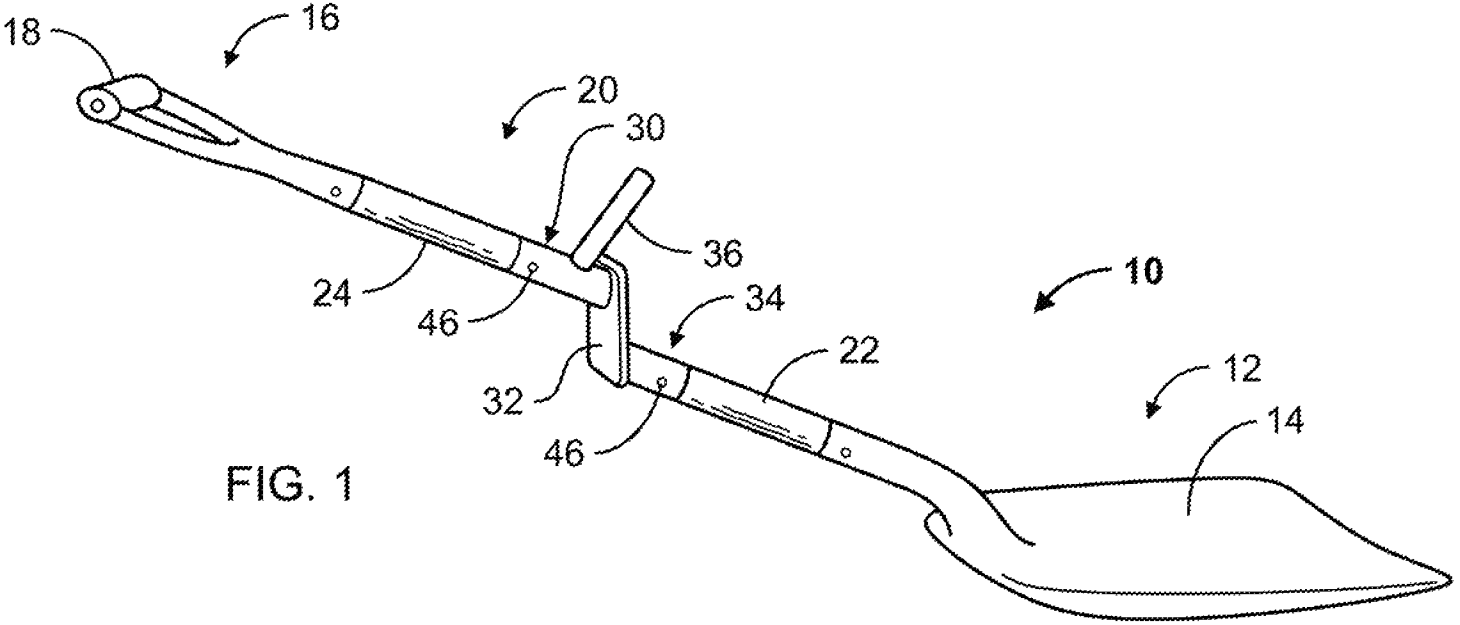
FIG. 1 is a side view of a shovel in one embodiment of the present invention.

The present invention is a handle attachment for a hand tool. FIG. 1 is a side view of a shovel 10 in one embodiment of the present invention. The shovel 10 includes a first end 12 having a hand tool implement, such as a shovel blade 14 and a second end 16 having a handle 18. Unlike conventional shovels having an elongated member running from the first end to the second end, in one embodiment, the present invention includes a step down mechanism 20 located between the first end 12 and the second 16. The step down mechanism is attached to a lower shaft 22 adjacent the first end 12. The step down mechanism 20 is also attached to an upper shaft 24 adjacent the second end 16. The lower shaft 22 and the upper shaft 24 are actually derived from existing hand tools having one elongated unitary member where no step down mechanism is used. However, in the present invention, the traditional unitary shaft or member of the hand tool is divided into the upper shaft 24 and the lower shaft 22 and affixed to the step down mechanism 20. The step down mechanism 20 laterally displaces or steps down the lower shaft 22 from the upper shaft 24. Specifically, the lateral displacement is between a lower axis running through the lower shaft and an upper axis running through an upper shaft. The unitary shaft of an existing hand tool may be cut to form the upper and lower shafts.

Figure 4:
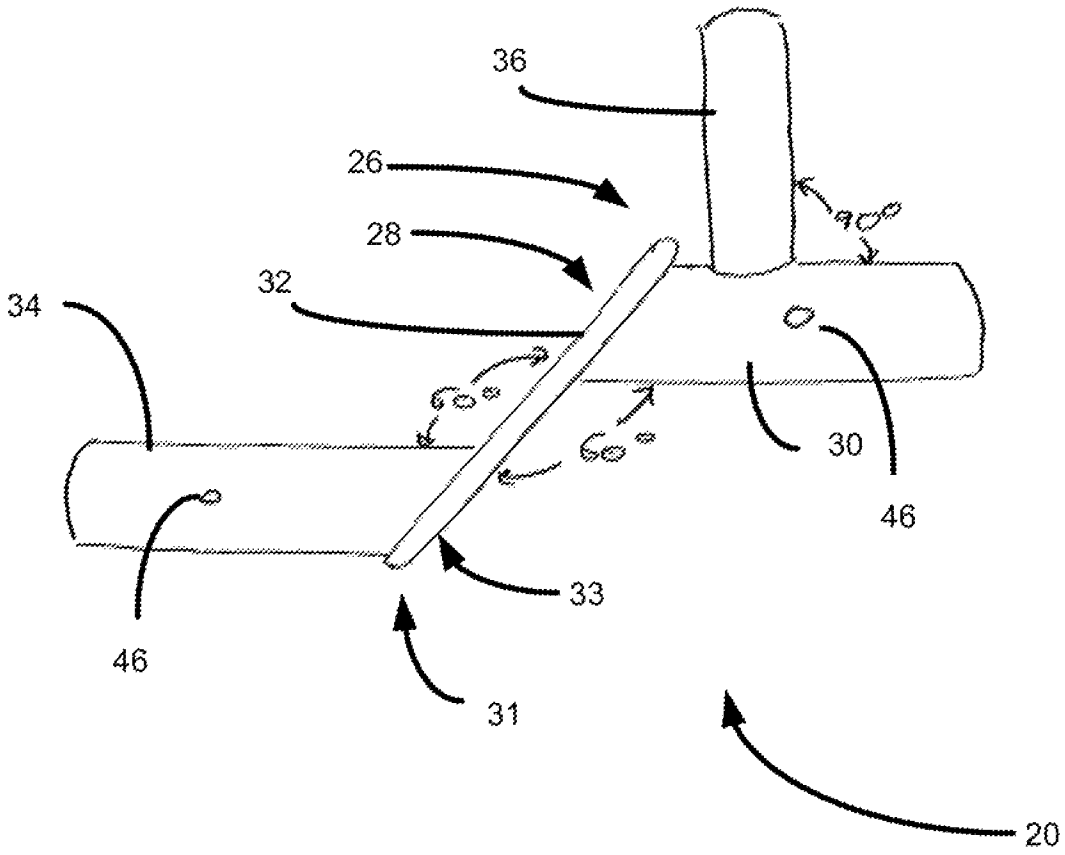
FIG. 4 is a side view of the step down mechanism of FIG. 1 in one embodiment of the present invention.

The step down mechanism 20 includes an upper tube 30 attached to a first end 26 and first side 28 of plate 32. On an opposite end 31 and opposing side 33 of the plate 32 relative to the upper tube 30 is a lower tube 34 (see FIG. 4). As shown in FIG. 4, the upper tube projects out 180 degrees in an opposite direction from the lower tube. A handle 36 is affixed outwardly from the upper tube 30 at approximately a 90 degree angle.

Figure 2:
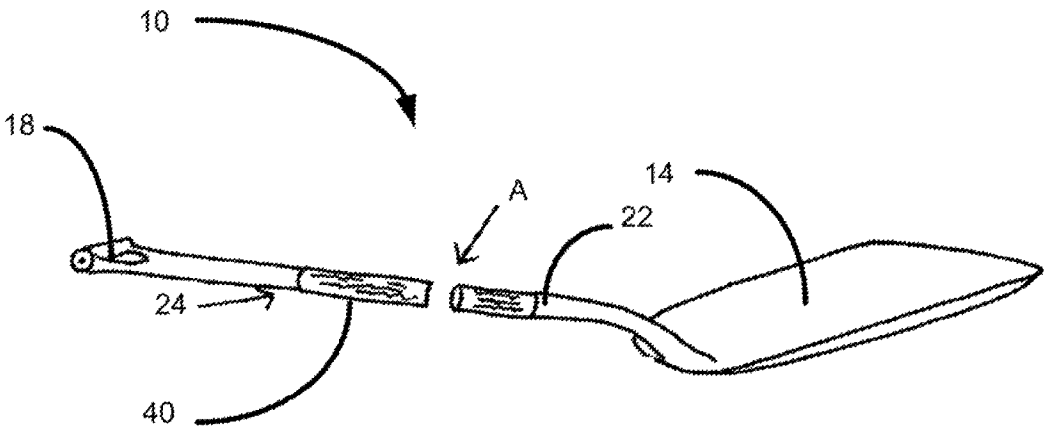
FIG. 2 (Prior Art)
FIG. 2 illustrates a conventional existing shovel with a unitary shaft cut to show the lower shaft and the upper shaft.
Figure 3:
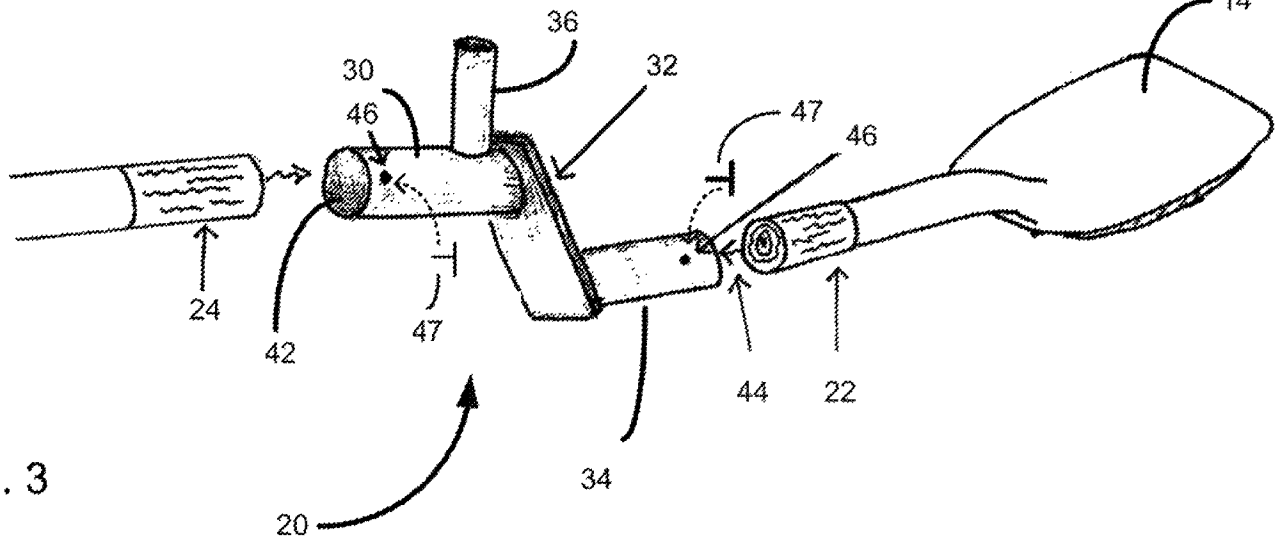
FIG. 3 illustrates the step down mechanism of FIG. 1 being positioned between the lower shaft and the upper shaft.

FIG. 2 illustrates a conventional existing shovel 10 with a unitary shaft 40 cut at point A, thereby providing the lower shaft 22 and the upper shaft 24. The shaft 40 is cut to allow attachment to the step down mechanism 20. FIG. 3 illustrates the step down mechanism being positioned between the lower shaft 22 and the upper shaft 24. As depicted in FIG. 3, the upper shaft 24 and the lower shaft 22 are tubular. The upper tube 30 is sized and shaped to receive the upper shaft 24 within a hollow portion 42 of the upper tube 30. Likewise, the lower tube is sized and shaped to receive the lower shaft in a hollow portion 44 of the lower tube 34.

FIG. 4 is a side view of the step down mechanism 20 in one embodiment of the present invention. The handle 36 may project from the upper tube 30 at approximately a 90 degree angle relative to the surface of the upper tube 30. However, the angle of the handle relative to the upper tube may be any angle and still remain in the scope of the present invention. In one embodiment, the upper tube may be cut at a 60 degree angle and attached to the plate 32. Furthermore, the lower tube 34 may also include a 60 degree cut on the end affixed to the plate 32. As depicted in FIG. 4, the plate is thus positioned at a 60 degree angle relative to the projecting upper and lower tubes. However, the plate relative angle may vary from 60 degrees and still remain in the scope of the present invention. The upper tube 30 and lower tube 34 may each have one or more set screw orifices 46 allowing insertion of set screws 47 (see FIG. 3) for holding the lower shaft 22 and upper shaft 24 of the shovel in place within the hollow portions of the upper and lower tubes. The upper and lower tube and the handle may be affixed by any attachment means, such as by welding or using attached joints. In other embodiments, the step down mechanism may be constructed from an injection molding process. The placement of the upper and lower tubes upon the plate may take any form and still remain within the scope of the present invention.

Figure 5:
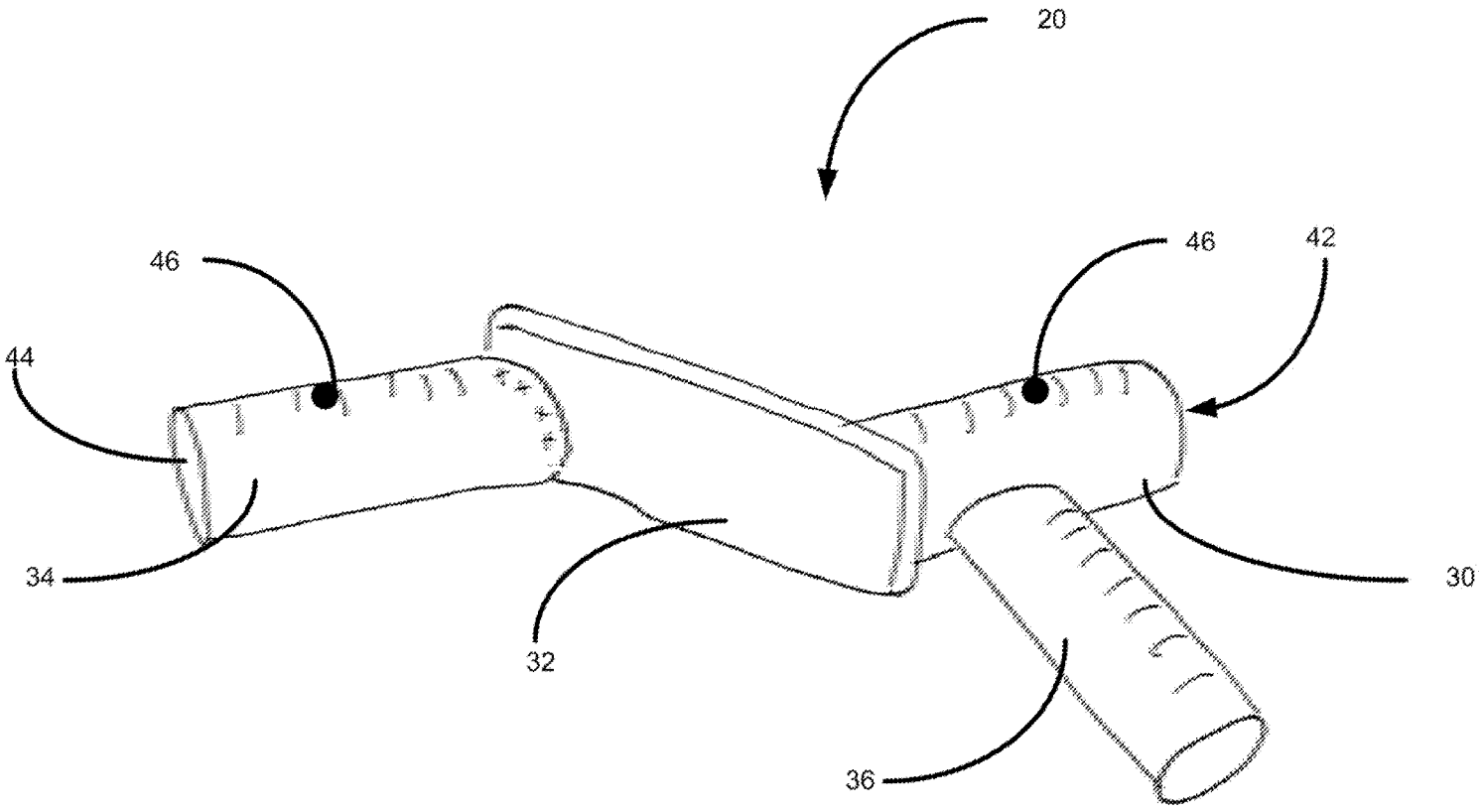
FIG. 5 is a bottom view of the step down mechanism of FIG. 1.

FIG. 5 is a bottom view of the step down mechanism 20. The lower tube 34 includes the hollow portion 44 sized and shaped to snugly fit the lower shaft 22 of the hand tool. In a similar manner, the upper tube 30 may include the hollow portion 42 with a size and shape to snugly fit the upper shaft 24 of the hand tool. The upper and lower tubes are preferably tubular in shape, however, may be any shape to accommodate the shape of the lower and upper shafts. The hollow portions 42 and 44 may be approximately 1.375 inches in diameter. The upper and lower tubes may include a wall surface depth of approximate 0.125 inches and constructed of a rigid material such as steel or durable composite or plastic. The upper and lower tubes may have a length of approximately 4 inches. The plate 32 may have a width of approximately 2 inches and a length of approximately 5.33 inches. Additionally, the handle 36 may be tubular in shape and sized and shaped to fit a user's hand. In one embodiment, the handle may have a diameter of approximately 1 inch and a length of approximately 4 inches. The handle, although depicted as projecting out at a 90 degree angle from the upper tube may project out at any angle and may be positioned anywhere on the step down mechanism 20 and still remain within the scope of the invention. Additionally, although dimensions have been given for the step down mechanism, the size and configuration of the step down mechanism and its components may vary and still remain in the scope of the present invention.

Figure 6:
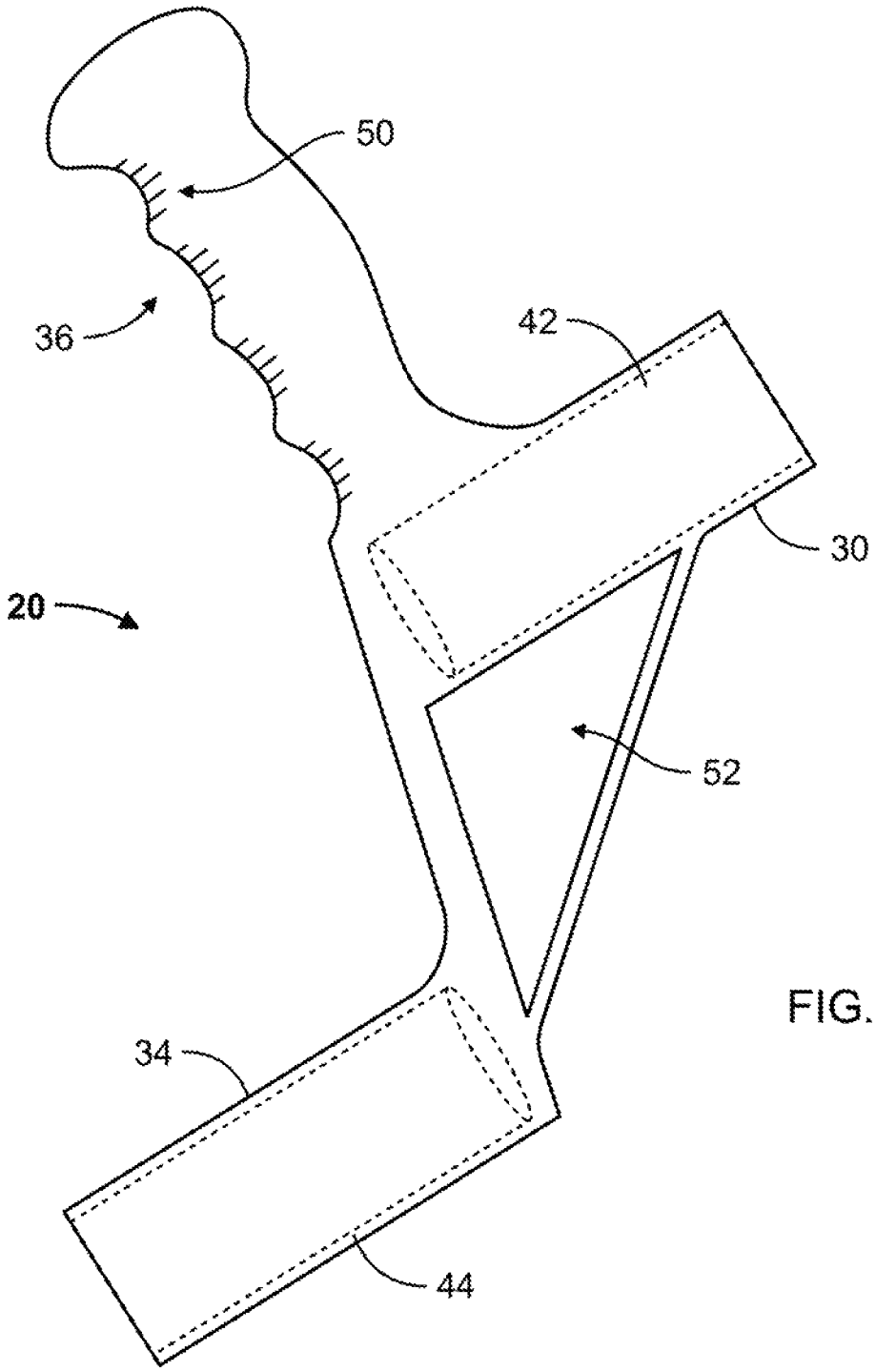
FIG. 6 is a side view of the step down mechanism in a second embodiment of the present invention.

FIG. 6 is a side view of the step down mechanism 20 in a second embodiment of the present invention. In this embodiment, the handle 36 includes a contoured grip 50. The contoured grip is contoured to fit a user's hand. Additionally, the step down mechanism includes a stability wedge 52 providing stability and strength to the step down mechanism 20. The stability wedge may be affixed by welding or other attachment means to the step down mechanism. The stability wedge may be a solid rigid structure to support the plate against the upper tube. As depicted in FIG. 6, the upper and lower tubes each include a 3.5 inch hollow portion.

Figure 7:
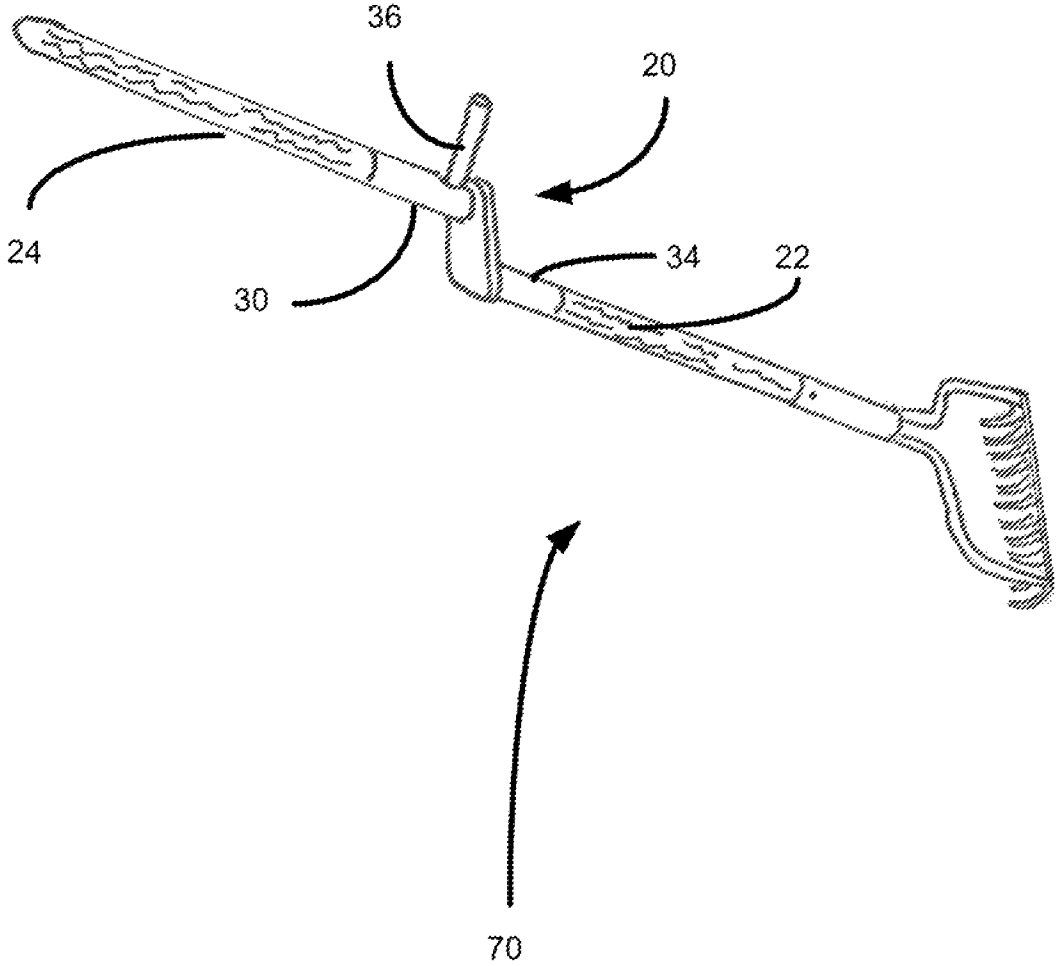
FIG. 7 is a side view of a rake in another embodiment of the present invention.
Figure 8:
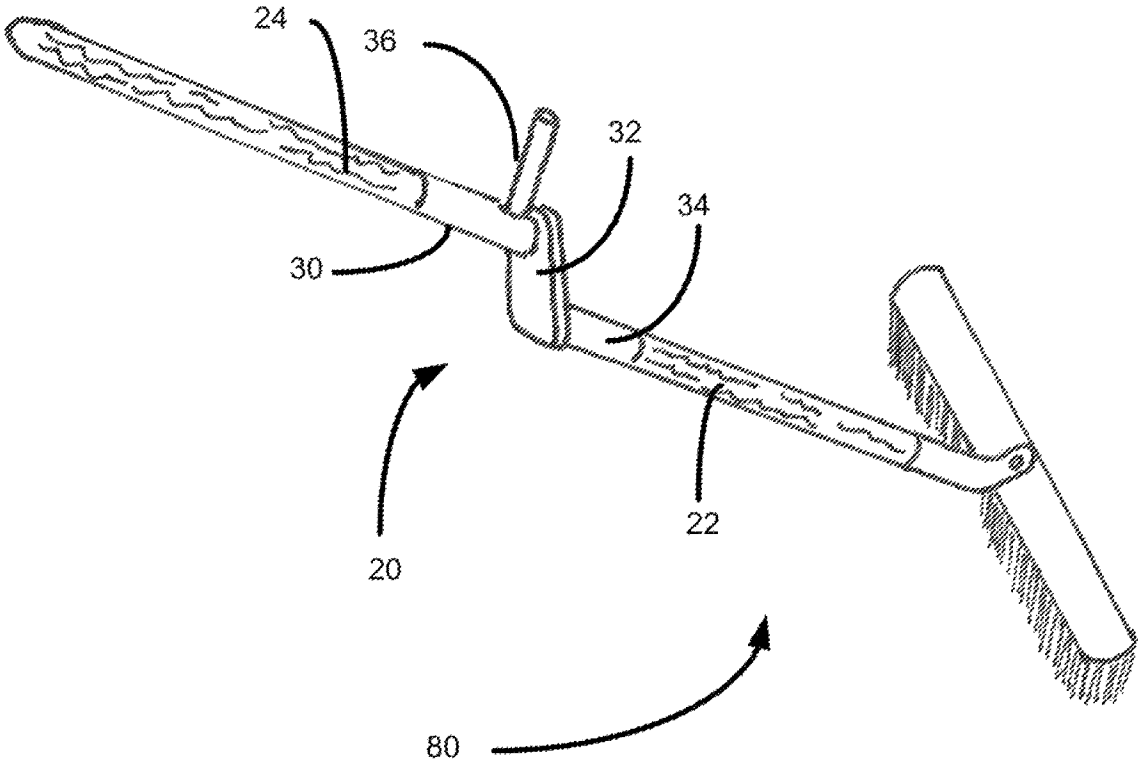
FIG. 8 is a side view of a broom in another embodiment of the present invention.

Although a shovel is depicted in FIGS. 1-6, the present invention may be utilized with other hand tools. FIG. 7 is a side view of a rake 70 in another embodiment of the present invention. The step down mechanism 20 may be utilized with any type of hand tool having an elongated member. As depicted in FIG. 7, the rake 70 includes the lower shaft 22 and the upper shaft 24 attached within the upper and lower tubes of the step down mechanism. FIG. 8 is a side view of a broom 80 in another embodiment of the present invention. The step down mechanism is shown being used as a broom. The present invention may be used on any hand tool having an elongated shaft. The present invention may also be used on any hand tool of any size and shape.

The step down mechanism may be used for existing hand tools. In this embodiment, an existing hand tool, such a shovel, has its shaft 40 cut into at least two sections. The first lower shaft 22 is inserted into the lower tube 34. A set screw (not shown) is inserted into the set screw orifice 46 and embedded into the lower shaft, thereby affixing the lower shaft to the step down mechanism 20. Likewise, the upper shaft 24 is inserted in into the hollow portion 42 of the upper tube 30. A set screw may also be inserted through the set screw orifice 46 and embedded into the upper shaft. The present invention may use other attachment devices to hold the shafts in place. In another embodiment, the hand tool may be constructed with the step down mechanism integrated into the shaft where attachment means may not be necessary. In another embodiment, the step down mechanism may not include the handle and only include the upper and lower tubes providing the step down function without an additional handle.

The step down mechanism enables the user to hold the hand tool on the handle 36 while not requiring the user to stoop as low as with a conventional hand tool. The present invention enables the user to comfortably hold the hand tool without extending the user's wrist. Furthermore, less strain is placed on the user's lower back by using the step down mechanism.

Figure 9:
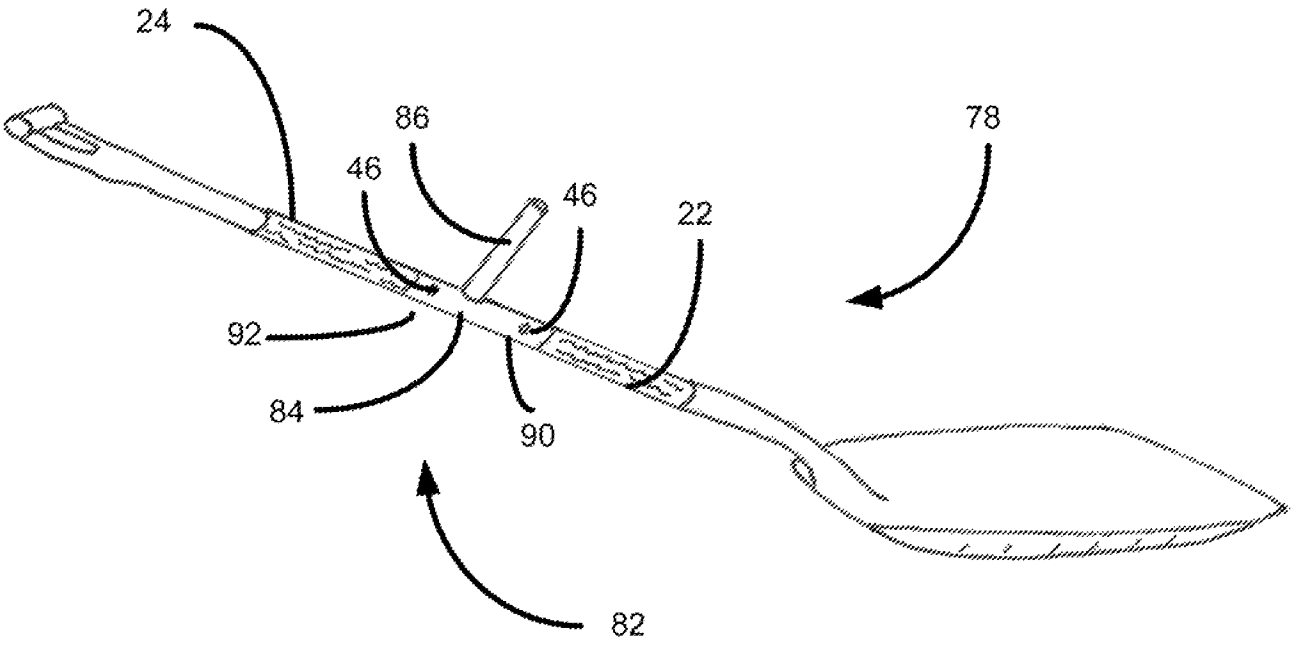
FIG. 9 is a side view of a shovel having an upright handle attachment in another embodiment of the present invention.

In an alternate embodiment, the present invention may provide an upright handle for the hand tool without the step down feature of the step down mechanism 20. FIG. 9 is a side view of a shovel 78 having an upright handle attachment 82 in another embodiment of the present invention. The upright handle attachment 82 is "T" shaped having an elongated tube section 84 and an upright handle 86. The elongated tube section includes a lower tube 90 and an upper tube 92 on the opposite end. The upper and lower tubes are aligned in the same axis and may each include hollow portions on each end to accommodate the upper shaft 24 and lower shaft 22. The upright handle may be affixed in a similar manner as the handle 36 with welding or other attachment mechanisms. The handle may be contoured. As depicted in FIG. 9, the handle is affixed at a 90 degree angle relative to the elongated tube portion section 84. However, in other embodiments, the handle may be affixed at an angle. The upper and lower shafts of the hand tool may be affixed within the hollow portions by set screws or other fastening devices. The handle attachment 82 may be incorporated into the handle as a unitary part of the shaft of the hand tool or, in a similar manner as the step down mechanism 20, may be used with an existing conventional hand tool where the shaft is cut and the upper and lower shafts are inserted within the elongated tube section of the handle attachment 82.

Figure 10:
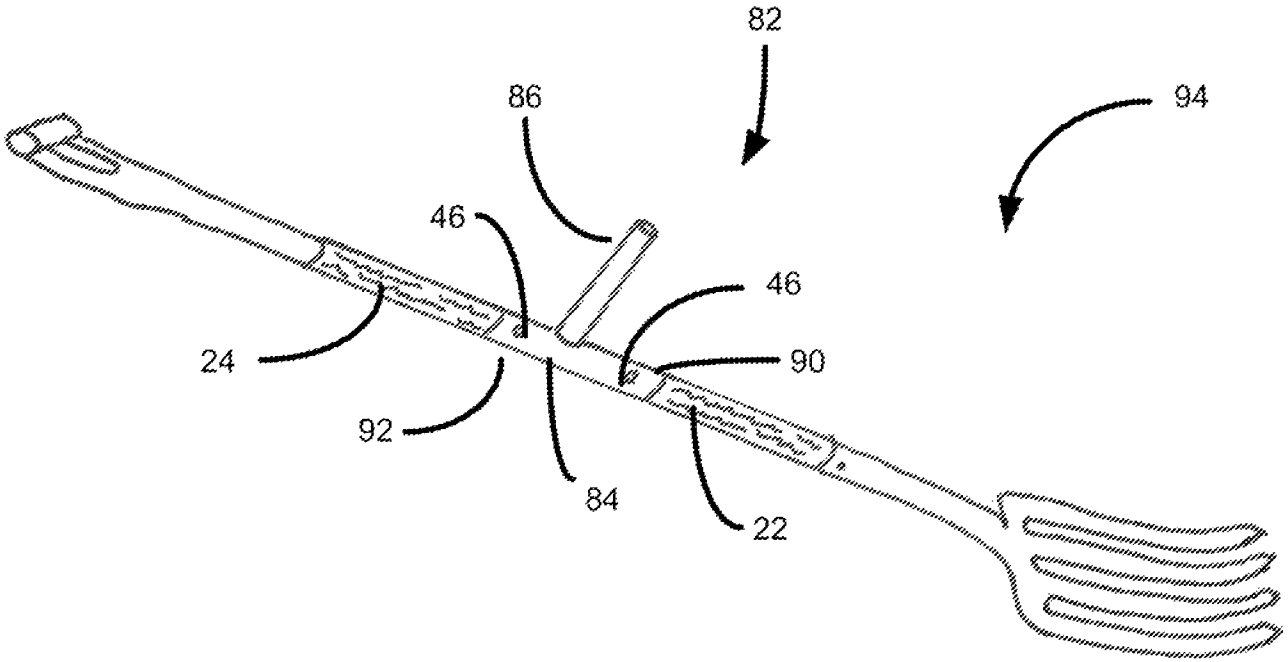
FIG. 10 is a side view of a rake with the upright handle attachment.

The handle attachment 82 may also be utilized with other hand tools. FIG. 10 is a side view of a rake 94 with the upright handle attachment 82. In a similar fashion as the shovel 78 depicted in FIG. 9, the upright handle attachment 82 may be used with the rake 94.

The handle attachment 82 may be utilized with any type of hand tool and is not limited to just rakes or shovels. The handle attachment may be used with existing hand tools or incorporated into the design of new hand tools. The present invention provides an upright handle allowing the user to easily use the hand tool while gripping the hand tool in a comfortable manner.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A hand tool having a step down mechanism, the hand tool comprising:

a step down mechanism comprising:

a plate having a first end and an opposite second end, the plate having an upper surface and a lower surface;

an upper tube located near the first end and projecting from the upper surface; and a lower tube located near the second end and projecting from the lower surface; and a hand tool comprising;

an upper shaft affixed to the upper tube; and a lower shaft affixed to the lower tube, the lower shaft having a hand tool implement affixed to an end of the lower shaft;

wherein the upper tube is sized and shaped to receive and hold the upper shaft and the lower tube is sized and shaped to receive and hold the lower shaft;

wherein the upper tube and affixed upper shaft are aligned parallel to the lower tube and affixed lower shaft;

wherein the upper tube and affixed upper shaft project 180 degrees in an opposite direction from the lower tube and affixed lower shaft simultaneously while the upper tube and affixed upper shaft are aligned parallel to the lower tube and affixed lower shaft;

wherein the upper tube and lower tube are in a fixed angular position on the plate;

wherein the step down mechanism is configured to laterally displace the lower shaft down from the upper shaft, wherein the step down mechanism laterally displaces downward from an upper axis through the upper shaft to a lower axis through the lower shaft.

2. The hand tool according to claim 1 wherein the upper tube includes a handle projecting upward from the upper tube.

3. The hand tool according to claim 2 wherein the handle is contoured for a user's hand.

4. The hand tool according to claim 1 wherein the plate is aligned at an angle relative to the upper and lower tubes.

5. The hand tool according to claim 4 wherein the plate is aligned at approximately a sixty degree angle relative to the upper and lower tubes.

6. The hand tool according to claim 1 wherein upper shaft is affixed to the upper tube with at least one set screw.

7. The hand tool according to claim 1 wherein the lower shaft is affixed to the lower tube with at least one set screw.

8. The hand tool according to claim 1 wherein the plate includes a stability wedge to support the upper tube against the plate.

9. The hand tool according to claim 1 wherein the upper tube and the lower tube each includes a hollow portion for accommodating an upper or lower shaft.

10. A step down mechanism for a hand tool, the step down mechanism comprising:

a plate having a first end and an opposite second end, the plate having an upper surface and a lower surface;

an upper tube located near the first end and projecting from the upper surface; and a lower tube located near the second end and projecting from the lower surface;

wherein the upper tube is sized and shaped to receive and hold an upper shaft of a hand tool and the lower tube is sized and shaped to receive and hold a lower shaft of a hand tool;

wherein the upper tube is aligned parallel to the lower tube;

wherein the upper tube and affixed upper shaft project 180 degrees in an opposite direction from the lower tube and affixed lower shaft simultaneously while the upper tube and affixed upper shaft are aligned parallel to the lower tube and affixed lower shaft;

wherein the upper tube and lower tube are in a fixed angular position on the plate;

wherein the step down mechanism is configured to laterally displace the lower shaft from the upper shaft, wherein the step down mechanism laterally displaces downward from an upper axis through the upper shaft to a lower axis through the lower shaft.

11. The step down mechanism according to claim 10 wherein the upper tube includes a handle projecting upward from the upper tube.

12. The step down mechanism according to claim 11 wherein the handle is contoured for a user's hand.

13. The step down mechanism according to claim 10 wherein the plate is aligned at an angle relative to the upper and lower tubes.

14. The step down mechanism according to claim 13 wherein the plate is aligned at approximately a sixty degree angle relative to the upper and lower tubes.

15. The step down mechanism according to claim 10 wherein the plate includes a stability wedge to support the upper tube against the plate.

16. The step down mechanism according to claim 10 wherein the upper tube and the lower tube each includes a hollow portion for accommodating an upper or lower shaft.

* * * * *